US007050601B2

(12) United States Patent
Suzuki et al.

(10) Patent No.: US 7,050,601 B2
(45) Date of Patent: May 23, 2006

(54) VOICE COIL OF SPEAKER

(75) Inventors: Takashi Suzuki, Mie (JP); Shinya Mizone, Mie (JP); Tsuneaki Rikiishi, Gunma (JP); Junsuke Hotani, Gunma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 29 days.

(21) Appl. No.: 10/490,627

(22) PCT Filed: Jul. 16, 2003

(86) PCT No.: PCT/JP03/09044

§ 371 (c)(1),
(2), (4) Date: Mar. 25, 2004

(87) PCT Pub. No.: WO2004/010731

PCT Pub. Date: Jan. 29, 2004

(65) Prior Publication Data

US 2004/0197006 A1 Oct. 7, 2004

(30) Foreign Application Priority Data

Jul. 19, 2002 (JP) ..... 2002-210318

(51) Int. Cl.
*H04R 25/00* (2006.01)

(52) U.S. Cl. ..... 381/409; 381/400

(58) Field of Classification Search ..... 381/394, 381/400–403, 405–410; 29/594; 174/24, 174/28–29
See application file for complete search history.

(56) References Cited

U.S. PATENT DOCUMENTS 6,922,477 B1 * 7/2005 Ikeyama ..... 381/409

FOREIGN PATENT DOCUMENTS

| | | |
|---|---|---|
| JP | 45-22391 | 9/1970 |
| JP | 6-77043 | 3/1994 |
| JP | 6-209497 | 7/1994 |
| JP | 9-246080 | 9/1997 |
| JP | 11-213775 | 8/1999 |
| JP | 2001-61200 | 3/2001 |

* cited by examiner

*Primary Examiner*—Suhan Ni
(74) *Attorney, Agent, or Firm*—Wenderoth, Lind & Ponack, L.L.P.

(57) ABSTRACT

A speaker is provided in which a coil wire can withstand a large amplitude motion caused by vibration of a voice coil bobbin and a diaphragm, and in which a bias of weight of the voice coil bobbin and the diaphragm caused by a constitution of the coil wire is reduced to a minimum. The coil wire, winding around the voice coil bobbin, is composed of a core thread having a bending strength and a heat-resistance and is wound by a conductive material. An end of the coil wire is directly connected to an external input terminal attached to a frame.

11 Claims, 4 Drawing Sheets

VOICE COIL OF SPEAKER

TECHNICAL FIELD

This invention relates to a speaker to be used for various audio electronic devices.

BACKGROUND ART

Speakers have recently been compacted, and input power to the speaker is increasing.

There are two methods for connecting a coil wire of a voice coil to an external input terminal of speaker, as is disclosed in Japanese Patent Laid-Open No. H6-209497. In one method, the coil wire is directly connected to the external terminal, which is herein called type A. In another method, the coil wire is connected to the external terminal by means of a flexible wire (FW), which is herein called type B. The flexible wire (FW) is preferred to be a wire in which a core thread is wound by a copper foil, and then the copper foiled core threads are braided together or stranded, forming the FW which is generally called a "kinshisen" in Japanese.

FIG. 4 is a cross-sectional view of a conventional external-magnet type speaker. Magnetic circuit 40 is composed of lower plate 10 including a center pole, upper plate 30, and magnet 20. Frame 50 is mounted on an upper side of the magnetic circuit 40. An outer rim of diaphragm 60 is fixed to an inner rim of frame 50, and an inner rim of diaphragm 60 is fixed to an outer rim of voice coil bobbin 80 placed in magnetic gap 40A of magnetic circuit 40. Voice coil bobbin 80 is wound up by voice coil 70. External input terminal 90 is attached to frame 50. Damper 100 is fixed to frame 50 and voice coil bobbin 80. Dust cap 110 is fixed over and above a joint portion of diaphragm 60 and voice coil bobbin 80. The speaker described above belongs to type B in the connecting method. Coil wire 12 is wound on voice coil bobbin 80, and each end of the wire is drawn from voice coil bobbin 80 along an axis of the bobbin and is connected to one end of FW 13 at an upper surface of diaphragm 60, while the other end of the FW is connected to external input terminal 90. Another example of type B is shown in FIG. 5, in which each end of coil wire 12 is drawn along the axis of voice coil bobbin 80 and is connected to one end of FW 13 at an outer peripheral surface of voice coil bobbin 80, the other end of the FW being connected to external input terminal 90.

In type A, although it is not illustrated, each end of coil wire 12 is drawn from the outer periphery of voice coil bobbin 80 and is directly connected to external input terminal 90.

Type B speaker which is shown in FIGS. 4 and 5, in which coil wire 12 is relayed by FW 13 to be connected to external input terminal 90, withstands a large amplitude motion caused by a large input signal. However, on the other hand, FW 13 is thick and heavy. Furthermore, because voice coil wire 12 is connected to FW 13 at the upper surface of diaphragm 60 or at the outer peripheral surface of voice coil bobbin 80, weight of adhesive and solder is applied to voice coil bobbin 80 and diaphragm 60, biasing their weight toward an outer region and thus obstructing smooth amplitude motion and causing unsatisfactory sound quality. When the bias is serious, it becomes a reason for sound failure. Type A, in which coil wire 12 is directly connected to external input terminal 90, achieves smoother amplitude motion of voice coil bobbin 80 and diaphragm 60 by an amount of the FW being saved. However, because coil wire 12 has two bending points, one where the wire is drawn out of voice coil bobbin 80 and another where the wire is connected to external terminal 90, the probability of wire breakage tends to increase as power at an input signal increases accompanying a larger amplitude motion.

It is an object of the present invention to provide a speaker in which the coil wire withstands the large amplitude motion which the voice coil bobbin and the diaphragm experience when vibrating, and in which the biased weight of the voice coil bobbin and the diaphragm caused by the constitution of the coil wire is controlled to be a minimum. Thus, the speaker is endowed with a high reliability and a superior sound quality.

SUMMARY OF THE INVENTION

A speaker includes a magnetic circuit, a frame having a rim mounted on the magnetic circuit, a diaphragm having an inner rim fixed to a voice coil bobbin placed in a magnetic gap of the magnetic circuit and having an outer rim fixed to another rim of the frame, and an external input terminal attached to the frame. A coil wire wound around the voice coil bobbin is composed of a core thread wound by a conductive material having a bending strength and a heat-resistance, and the coil wire is directly connected to the external input terminal.

DETAILED DESCRIPTION OF THE PREFERRED EMBODIMENT

Figure 2:
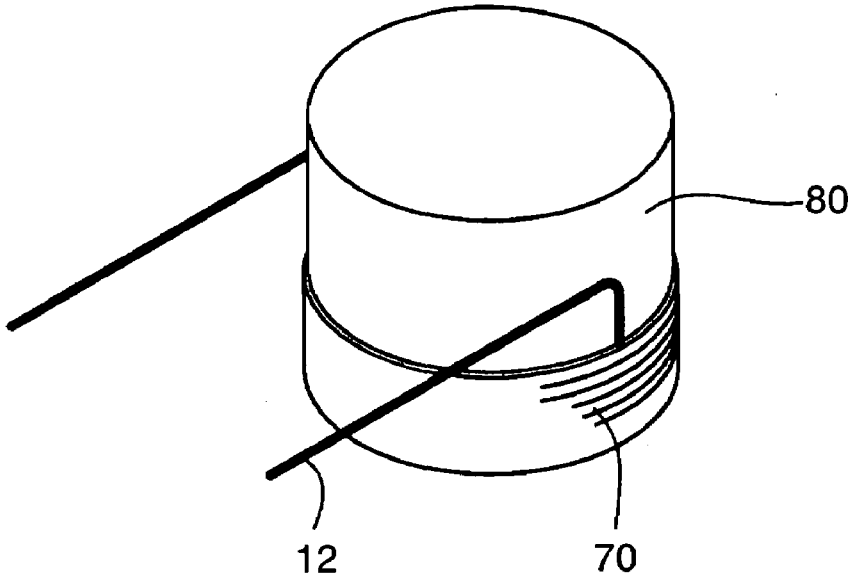
FIG. 2 is a perspective view of a voice coil installed in the speaker in accordance with the exemplary embodiment of the present invention.
Figure 3:
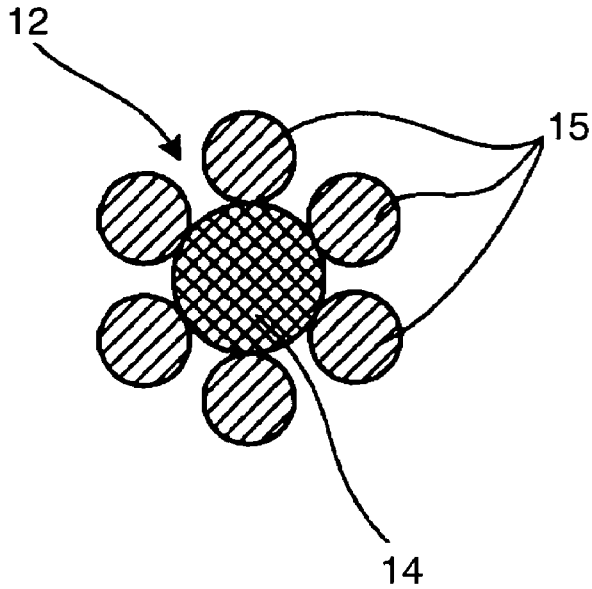
FIG. 3 is a cross-sectional view of the voice coil installed in the speaker in accordance with the exemplary embodiment of the present invention.

An exemplary embodiment of this invention is described hereinafter using drawings FIGS. 1 to 3. In the drawings, constituent components of this invention are given the same reference marks as that of a conventional invention, and detailed explanation of the components is omitted. The drawings are schematic diagrams and do not necessarily correctly indicate a position of each constituent component.

EXEMPLARY EMBODIMENT

Figure 1:
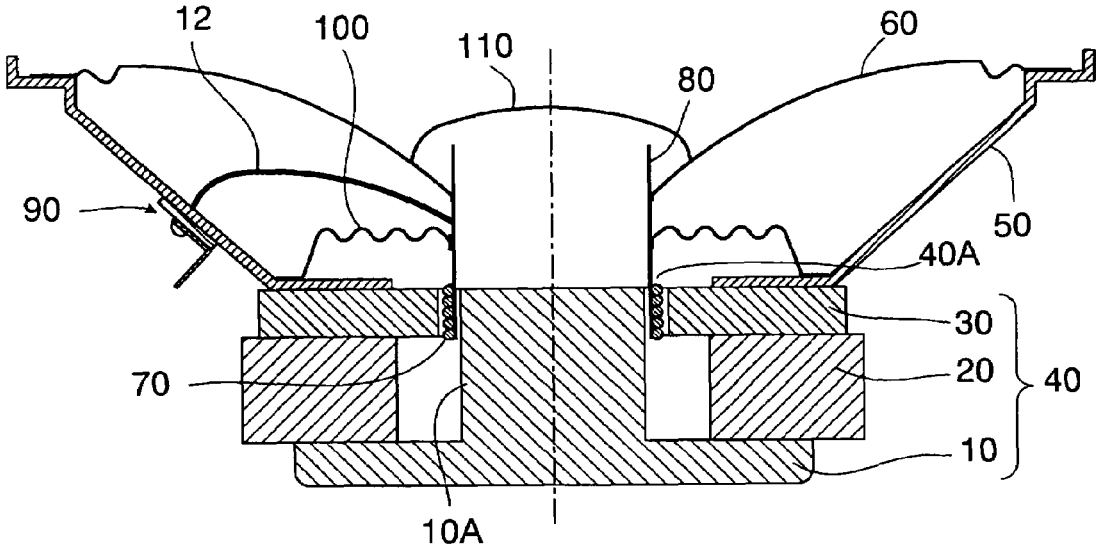
FIG. 1 is a cross-sectional view of a speaker in accordance with an exemplary embodiment of the present invention.

In FIG. 1, magnetic circuit 40 is composed of lower plate 10 having center pole 10A, upper plate 30, and magnet 20. Frame 50 is mounted on an upper side of magnetic circuit 40. An outer rim of diaphragm 60 is fixed to an inner rim of frame 50, and an inner rim of diaphragm 60 is fixed to voice coil bobbin 80 placed in magnetic gap 40A of the magnetic circuit 40. A voice coil 70 is wound around voice coil bobbin 80. External input terminal 90 is attached to frame 50. Damper 100 is fixed to frame 50 and voice coil bobbin 80.

Dust cap 110 is fixed over and above a joint portion connecting diaphragm 60 and voice coil bobbin 80.

Figure 4:
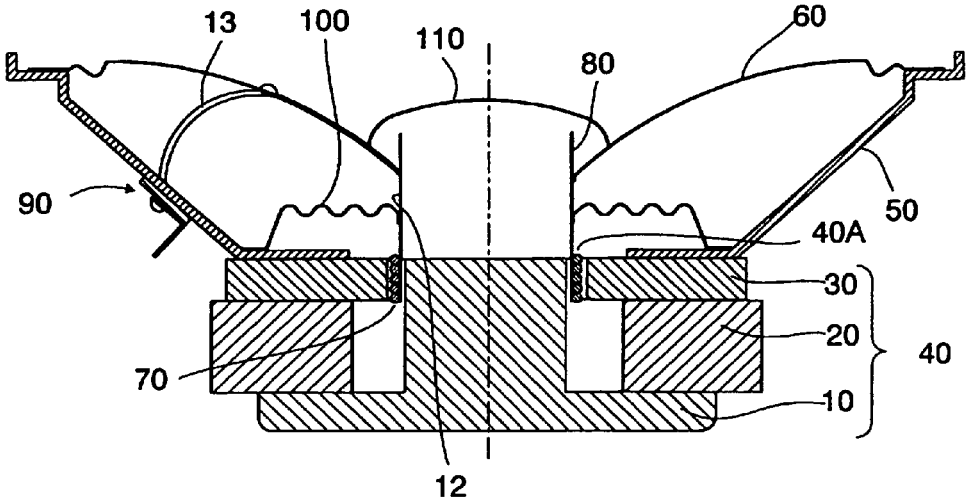
FIG. 4 PRIOR ART
FIG. 4 is a cross-sectional view of a conventional speaker.
Figure 5:
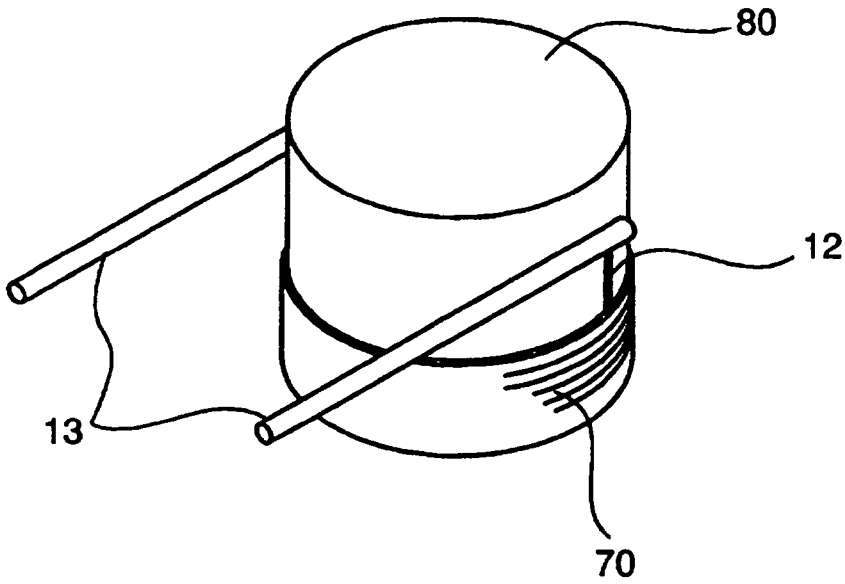
FIG. 5 PRIOR ART
FIG. 5 is a perspective view of a voice coil installed in the conventional speaker.

A speaker in FIG. 1 according to the exemplary embodiment of the present invention differs from a speaker according to the prior art in FIG. 4 in the following points. As is shown by FIG. 3, coil wire 12 wound around voice coil bobbin 80 is composed of core thread 14 around which is wound conductive material 15. Each end of coil wire 12 is drawn along an axis of voice coil bobbin 80 as shown in FIG. 2. It extends out from an outer periphery of voice coil bobbin 80 and is directly connected to external input terminal 90 by soldering, for example. Core thread 14 is made of a material having a bending strength and resistance to heat such as that of live voice coil 70 and the soldering temperature. A cotton thread or a chemical fiber is preferably used for the thread. Conductive material 15 is a round wire (i.e., a wire having a circular cross section) or a foil of a conductive material. Conductive material 15 is coated with an insulating layer including a plastic-base or rubber-base insulating material, and the layer is sometimes further covered with a heat bonding layer. As the conductive material, material such as copper and copper alloy, and material having a lower specific gravity than those such as aluminum and aluminum alloy are used. Carbon fiber is also used. A plurality of conductive materials (wires) 15 are braised together, stranded, twisted, or spirally wound around core thread 14, forming the coil wire 12. Such winding methods are employed when a conventional FW is formed. However, as described in the constitution, because coil wire 12 includes core thread 14 having a strong bending strength, coil wire 12 does not break even if it is bent by a large amplitude vibration of voice coil bobbin 80 or diaphragm 60 which they generate when emitting sounds. Moreover, because the coil wire is not relayed by the FW, which is conventionally used for avoiding the breakage of the coil wire (refer to FIGS. 4 and 5), weight of the wires is correspondingly reduced. Namely, the weight of the wires is reduced by 30 to 60%. As a result, a biased weight of voice coil bobbin 80 and diaphragm 60 toward an outer region is reduced, and a smooth amplitude motion of those components is realized, ensuring reliability and a superb sound quality. Conductive material 15 is composed of aluminum having a specific gravity of 2.7 and copper having a specific gravity of 8.9. Assuming that conductivity of copper is 100, conductivity of aluminum is 62. Therefore, a weight of aluminum for obtaining an identical electric resistance as copper is reduced to ½ of copper. As demonstrated, use of aluminum is very effective in alleviating the biased weight of voice coil bobbin 30 and diaphragm 40. Use of a copper clad aluminum wire is also effective in saving the weight.

Material for core thread 14 and conductive material 15 is not limited only to the above-listed material, and material can be appropriately selected depending on a task such as cost and manufacturing and how to solve the task.

The exemplary embodiment of the present invention is described based on a speaker of an external magnet type. However, the invention can be applied to an internal magnet type as well.

INDUSTRIAL APPLICABILITY

With a speaker in the present invention, a coil wire is not broken even if a large amplitude motion is applied, and a smooth amplitude motion of a voice coil bobbin and of a diaphragm is realized. Thus, reliability is ensured and a superb sound quality is acheived. A FW conventionally used to avoid wire breakdown is no longer needed. Therefore constituent components and work processes are reduced in number, contributing to a cost reduction.

The invention claimed is:

1. A speaker comprising:

a magnetic circuit shaped to have a magnetic gap;

a frame having a first end portion mounted to said magnetic circuit, and having a second end portion;

a voice coil bobbin in said magnetic gap of said magnetic circuit;

a diaphragm having an inner rim fixed to said voice coil bobbin, and having an outer rim fixed to said second end portion of said frame;

an external input terminal attached to said frame; and a voice coil wound around said voice coil bobbin, and comprising conductive material around a core thread, said voice coil being directly connected to said external input terminal.

2. The speaker of claim 1, wherein said conductive material comprises at least one wire having a circular cross-section and wound around said core thread.

3. The speaker of claim 2, wherein each of said at least one wire having a circular cross-section is coated with a layer of insulating material.

4. The speaker of claim 2, wherein said at least one wire comprises a plurality of wires braised together, stranded, and spirally wound around said core thread.

5. The speaker of claim 1, wherein said conductive material comprises a metallic material.

6. The speaker of claim 5, wherein said metallic material comprises one of copper and aluminum.

7. The speaker of claim 1, wherein said conductive material comprises one of a wire having a circular cross-section and a foil.

8. The speaker of claim 7, wherein said conductive material is coated with a layer of insulating material, and covered with a heat bonding layer.

9. The speaker of claim 1, wherein said conductive material comprises carbon fiber.

10. The speaker of claim 9, wherein said carbon fiber comprises one of a wire having a circular cross-section and a foil.

11. The speaker of claim 9, wherein said carbon fiber is coated with a layer of insulating material, and covered with a heat bonding layer.

* * * * *